United States Patent [19]

Hauenstein

[11] Patent Number: 4,648,808

[45] Date of Patent: Mar. 10, 1987

[54] SEALING SHROUD CENTRIFUGAL PUMP

[75] Inventor: Ernst Hauenstein, Vordemwald, Switzerland

[73] Assignee: CP Pumpen AG, Zofingen, Switzerland

[21] Appl. No.: 753,142

[22] Filed: Jul. 9, 1985

[30] Foreign Application Priority Data

Jul. 16, 1984 [CH] Switzerland ..... 3450/84

[51] Int. Cl.[4] ..... F04B 39/04; F04B 17/00; F04D 29/06

[52] U.S. Cl. ..... 417/353; 417/420; 415/106; 415/110; 415/206

[58] Field of Search ..... 417/353, 420, 354; 415/122 R, 206, 105, 106, 110, 115, 116

[56] References Cited

U.S. PATENT DOCUMENTS

| | | | |
|---|---|---|---|
| 1,999,163 | 4/1935 | Allen | 415/105 |
| 3,520,642 | 7/1970 | Fulton | 417/420 |
| 3,597,117 | 8/1971 | Zoehfeld | 415/206 X |
| 3,969,042 | 7/1976 | Bachler | 417/420 X |
| 4,013,384 | 3/1977 | Oikawa | 417/420 X |
| 4,043,706 | 8/1977 | Walker | 417/353 |
| 4,047,847 | 9/1977 | Olkawa | 417/420 X |
| 4,120,018 | 10/1978 | Klaus | 417/420 |

FOREIGN PATENT DOCUMENTS

| | | | |
|---|---|---|---|
| 2620502 | 11/1976 | Fed. Rep. of Germany . | |
| 592499 | 5/1959 | Italy | 417/420 |
| 555477 | 10/1974 | Switzerland . | |

*Primary Examiner*—Robert E. Garrett
*Assistant Examiner*—Joseph M. Pitko
*Attorney, Agent, or Firm*—Werner W. Kleeman

[57] ABSTRACT

Inside the sealing shroud of the centrifugal pump there is located an inner rotor driven by a drive motor, while an outer rotor which is connected to the pump impeller is located outside of the sealing shroud wall. At least the sealing shroud wall is formed of a material which is electrically non-conductive. The efficiency is improved. Materials not normally used in sealing shrouds, such as ceramics, can be used for the same and this increases the usefulness or fields of application of the pump.

11 Claims, 2 Drawing Figures

SEALING SHROUD CENTRIFUGAL PUMP

CROSS REFERENCE TO RELATED APPLICATION

This application is related to my commonly assigned, co-pending U.S. patent application, Ser. No. 06/753,140, filed on July 9, 1985, and entitled "SEALING SHROUD CENTRIFUGAL PUMP", the disclosure of which is incorporated herein by reference.

BACKGROUND OF THE INVENTION

The present invention broadly relates to a new and improved construction of a sealing shroud centrifugal or rotary pump, hereinafter simply referred to as a centrifugal pump.

Generally speaking, the sealing shroud centrifugal pump of the present invention comprises a pump housing and a sealing shroud sealingly separating the pump housing at its drive side against the action of the pumped medium. The wall of the sealing shroud protruding from the shroud base or bottom engages between an inner rotor and an outer rotor, each of which rotors are provided with permanent magnets. One of the rotors is connected with a pump impeller and the other rotor is connected with a drive motor.

Centrifugal pumps of the aforementioned type are known from Swiss Patent No 555,477 and German Patent Publication No. 2,620,502, published Nov. 25, 1976. They have, as is usual with sealing shroud pumps, an outer rotor connected to the drive motor and an inner rotor connected with the pump impeller. The pump impellers with their inner rotors are at least partly mounted on the base or bottom of the sealing shroud, and in the aforementioned German Patent Publication No. 2,620,502, the sealing shroud base or bottom has interruptions or apertures so that the so-called mounting or bearing shaft of the pump impeller can be mounted in a bearing in the shaft of the outer rotor.

Because of the prevailing requirements of mechanical power transmission, these prior known sealing shrouds are mostly made of metal and thus electrically conductive. This construction leads to the formation of eddy currents, corresponding heating and loss of efficiency. Up to now, plastic sealing shrouds have not been sufficiently chemically resistant or mechanically robust. Therefore, the prior art pump construction comprises many parts and is complicated.

SUMMARY OF THE INVENTION

Therefore, with the foregoing in mind, it is a primary object of the present invention to provide a new and improved construction of a sealing shroud centrifugal pump which does not exhibit the aforementioned drawbacks and shortcomings of the prior art constructions.

A further important object of the present invention is to devise an improved construction of sealing shroud centrifugal pump which can be fabricated in an economically advantageous manner, possess improved efficiency, and which is particularly suitable for use as a chemical process pump.

Another noteworthy object of the present invention aims at providing a new and improved construction of sealing shroud centrifugual pump of the previously mentioned type containing a sealing shroud or can structure which is electrically non-conductive and therefore offers greater efficiency of operation due to the avoidance of the formation of eddy currents, and thus less heat build-up, affords the possibility of operation at elevated temperatures and is not affected by possible chemical action of the pumped medium.

Now in order to implement these and still further objects of the invention, which will become more readily apparent as the description proceeds, the sealing shroud centrifugal pump of the present invention is manifested by the features that the inner rotor arranged in the sealing shroud is connected, during operation of the centrifugal pump, with the drive motor, and the outer rotor, which is mechanically connected with the pump impeller, is arranged externally of the sealing shroud wall which is formed of an electrically nonconductive material.

If with the conventional constructions, an attempt was made to prevent the eddy current build-up in the sealing shroud wall by means of non-metallic materials, then there arose mechanical problems and because of the thick walls also magnetic problems, even if the chemical requirements could be fulfilled. In the past therefore, if an improvement of the efficiency was desired, the sealing shroud walls were kept as thin as possible and the rotors equipped with the magnets were located as close as possible to one another. This again brought an increase in the required precision which manifested itself in the multi-part, complicated mounting of the impeller shaft.

It has now been surprisingly found that with the complete reversed arrangement of the sealing shroud or can and the reversed operative correlation of the rotors to the drive motor and the pump impeller, it is possible to use electrically non-conductive materials for forming the sealing shroud wall while attaining increased efficiency in power or force transmission.

The entire structure may be designed such that in the sealing shroud wall there are almost only generated compressive stresses by the pumped medium and there occur tensile stresses only in the sealing shroud base or bottom and/or the flange or edge of the sealing shroud, which tensile stresses can be absorbed at these locations without any problems.

The preferred cantilever or overhang arrangement of the sealing shroud or can, which is only connected with other parts or components of the pump at the edge or flange of the sealing shroud, can be very advantageous for fulfilling these conditions.

An inwardly directed arching or doming of the base or bottom of the sealing shroud, in other words, when the sealing shroud base or bottom extends from the location of the sealing shroud wall inwardly from the pump impeller to the drive motor, is thus possible and allows the selection of a particularly favorable mounting or bearing arrangement.

It is possible, particularly with a preferred construction of the invention, to even use ceramics as the material for the sealing shroud wall or for even forming the entire sealing shroud. This can be extremely advantageous as concerns the corrosion resistance and thermal resistance, particularly if there are pumped hot media.

The sealing shroud base and/or the sealing shroud edge or flange can be constructed, without any problems, to possess an adequate thickness, whereas there can be used a relatively thin sealing shroud wall. In this way, it is possible to equally satisfy the electrical and magnetic requirements as well as the requirements concerning mechanical strength.

Furthermore, the sealing shroud can be designed to be preferably free of interruptions or apertures, and thus, there can be optimumly utilized its seal tightness and its mechanical strength.

Particularly, in the last mentioned situation, it is advantageous if the pump impeller together with the outer rotor are rotatably mounted upon an axle or shaft which is secured in the suction connection or stud of the pump housing, and the aforementioned arching or doming of the sealing shroud base or bottom affords a particularly favorable mounting or bearing arrangement.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
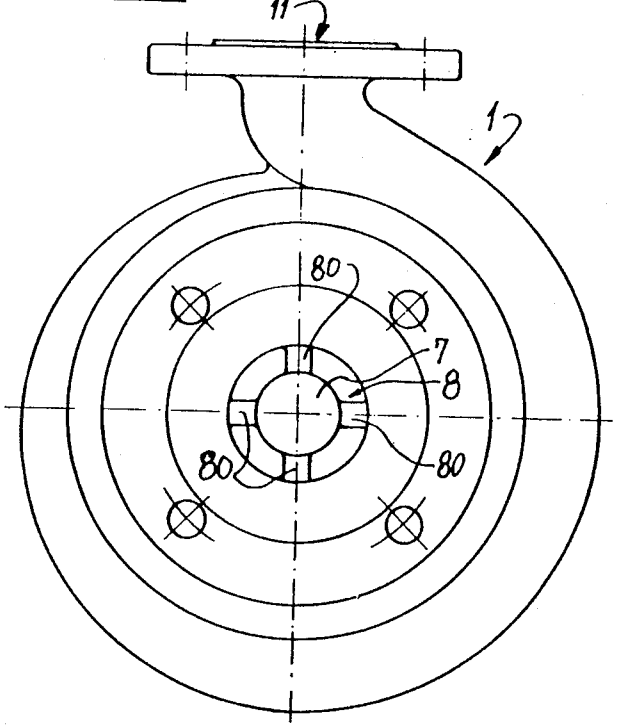
FIG. 1 schematically illustrates a front view of the inventive centrifugal pump viewed from the side of the suction connection.
Figure 2:
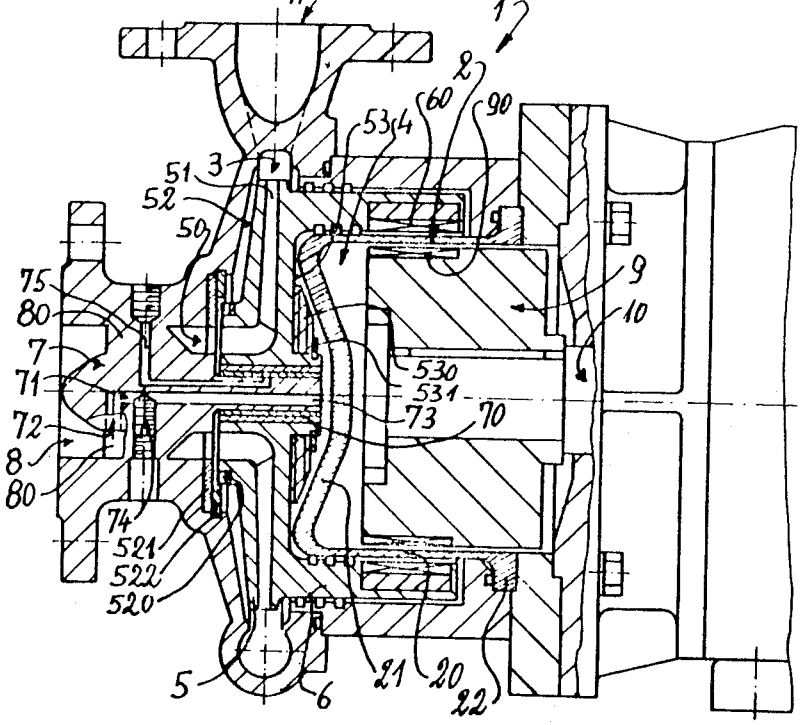
FIG. 2. is a longitudinal sectional view of the centrifugal pump depicted in FIG. 1.

Describing now the drawings, it is to be understood that to simplify the showing thereof, only enough of the structure of the exemplary embodiment of the sealing shroud centrifugal pump has been illustrated therein as is needed to enable one skilled in the art to readily understand the underlying principles and concepts of this present invention. Turning now specifically to FIGS. 1 and 2 of the drawings, the sealing shroud centrifugal pump depicted by way of example and not limitation therein will be seen to comprise a pump housing 1, in which there is sealingly inserted a sealing shroud or can 2. This sealing shroud 2 sealingly divides the inside of the pump housing 1 into a pump chamber 3 and a motor chamber 4, without any moving seals being necessary.

The substantially pot-shaped sealing shroud or can 2 has a sealing shroud wall 20 made of electrically non-conductive material and, in the example shown, is formed of one-piece with the sealing shroud base or bottom 21 and the sealing shroud flange or edge 22. In the exemplary embodiment under discussion, such sealing shroud 2 is shown as formed of ceramic material. The sealing shroud wall 20 must be electrically non-conductive, whereas this is not absolutely necessary for the sealing shroud base or bottom 21 and certainly not for sealing shroud flange or edge 22. Yet in a one-piece construction of the sealing shroud 2, such frequently can be the case.

Because of the arrangement and the construction of the sealing shroud 2, the sealing shroud wall 20 is practically only subjected to compressive stresses by the pumped medium which is advantageous because of its thin-walled construction notwithstanding the use of electrically non-conductive materials. The exposure of the sealing shroud wall 20 to practically only compressive stresses together with the construction of such sealing shroud wall of electrically non-conductive material results in an optimal efficiency. Electrically non-conductive materials which, for instance, can be used to form the sealing shroud wall or the entire sealing shroud are ceramics, such as commercially available PSZ-material (partially stabilized zirconium), density 5.91 kg/dm$^3$, hardness (Knupp) 11,700 N/mm$^2$, and bending strength 1020 N/mm$^2$.

The pump chamber 3 is provided with a radial pump impeller 5 whose suction opening 50 lies opposite to the suction connection 8 of the pump housing 1, whereas its radial channels 51 lead to the delivery or pressure connection 11 of the pump housing 1. No further openings are provided in the radial pump impeller 5 and it is only radially and rotatably mounted on the axle or shaft 7.

The part of the pump chamber 3 located at the front side 52 of the radial pump impeller 5 is flow connected or communicates via the gap between the throttling rings 520 and 521 (the latter is held by a retainer or holder ring 522) to the suction connection 8 and with the delivery or pressure connection 11. The part of the pump chamber 3 at the back or rear side 53 of the radial pump impeller 5 is connected around the outer rotor 6 with the delivery or pressure connection 11 and through an equalizing channel 71 in the axle or shaft 7 with the suction connection 8. A throttling ring 530 is fixed at the back or rear side 53 of the pump impeller 5 by means of a retainer or holder ring 531.

These design features together with the channel openings 72 and 73 of the equalizing channel 71 and the throttling screw 74 provided for the axle or shaft 7 and which throttling screw 74 is mounted on a supporting wing rib 80 of the suction connection 8, determine the axial position of the radial pump impeller 5 together with the thread-mounted outer rotor 6 carrying permanent magnets 60 in a manner more fully described in the aforementioned, commonly assigned U.S. patent application Ser. No. 06/753,140, filed July 9, 1985.

While as already described, the radial pump impeller 5 is mechanically fixedly connected to the outer rotor 6, the inner rotor 9, carrying the permanent magnets 90, is fixed to the motor 10, which arrangement constitutes a reversal of the conventional construction.

This together with the mentioned features of the sealing shroud 2 leads not only to an increase of efficiency, but also to a considerable lowering of the temperature, thereby requiring no special cooling means.

Contributing also to the foregoing, is the fact that the sealing shroud 2 is connected only on its flange or edge 22 with the pump housing 1 and needs no other connections, whereas heretofore conventionally, the sealing shroud base was designed to carry at least some load which naturally required consideration of the prevailing forces which here can be ignored. This flange or edge 22 may be thicker than the sealing shroud wall 20.

The sealing shroud base or bottom 21 is arched or domed towards the motor 10 which, besides having good static properties, also allows for good balancing of the impeller/outer rotor aggregate or unit. For this purpose, there can be used the axle or shaft 7 mounted in the suction connection 8 which contributes the advantages present in the previously mentioned, copending U.S. patent application Ser. No. 06/753,140. The sealing shroud wall 20 may be constructed to be thinner than the sealing shroud base or bottom 21.

Furthermore, the construction according to the invention, allows for the addition of a foreign lubricant channel 75 for the ceramic bearing 70.

While there are shown and described present preferred embodiments of the invention, it is to be distinctly understood that the invention is not limited thereto, but may be otherwise variously embodied and practiced within the scope of the following claims. Accordingly,

What I claim is:

1. A centrifugal pump for pumping a medium comprising:

a pump housing having a drive side;

a sealing shroud arranged within said pump housing and sealing the drive side of said pump housing against the action of the pumped medium;

said sealing shroud containing a sealing shroud base and sealing shroud wall protruding from said sealing shroud base;

an inner rotor equipped with permanent magnets;

an outer rotor equipped with permanent magnets and arranged in spaced relationship from said inner rotor;

said sealing shroud wall extending between said inner rotor and said outer rotor;

a pump impeller connected with said outer rotor;

a drive motor connected with the inner rotor;

said inner rotor connected with said drive motor being arranged within said sealing shroud;

said outer rotor connected with said pump impeller being arranged externally of said sealing shroud; and at least said sealing shroud wall being formed of electrically non-conductive material.

2. The centrifugal pump as defined in claim 1, wherein:

said sealing shroud is structured such that during operation of said centrifugal pump there are predominantly generated compressive stresses in the sealing shroud wall by the action of the pumped medium.

3. The centrifugal pump as defined in claim 1, wherein:

said sealing shroud is structured such that during operation of said centrifugal pump there are generated at least approximately only compressive stresses in the sealing shroud wall by the action of the pumped medium.

4. The centrifugal pump as defined in claim 1, wherein:

said sealing shroud further includes a sealing shroud flange;

means for mounting said sealing shroud at said sealing shroud flange at said pump housing such that said sealing shroud is supported in a cantilever fashion and only said sealing shroud flange comes into contact with other parts of the pump.

5. The centrifugal pump as defined in claim 4, wherein:

said sealing shroud flange, which is subjected to tensile stresses by the pumped medium, is thicker than said sealing shroud wall.

6. The centrifugal pump as defined in claim 1, wherein:

said sealing shroud base, starting at the region of said sealing shroud wall, is inwardly domed from the side of the pump impeller towards the drive motor.

7. The centrifugal pump as defined in claim 1, wherein:

said sealing shroud wall is structured to be thinner than said sealing shroud base which is subjected to tensile stresses by the pumped medium.

8. The centrifugal pump as defined in claim 1, wherein:

said pump housing is provided with a suction connection;

an axle secured in said suction connection of said pump housing; and said pump impeller together with the thereat connected outer rotor are rotatably mounted upon said axle.

9. The centrifugal pump as defined in claim 1, wherein:

said sealing shroud is devoid of interruptions.

10. The centrifugal pump as defined in claim 1, wherein:

at least said sealing shroud wall is formed of ceramic material.

11. A centrifugal pump for pumping a medium comprising:

a pump housing having a drive side;

a sealing shroud arranged within said pump housing and sealing the drive side of said pump housing against the action of the pumped medium;

said sealing shroud containing a sealing shroud base and sealing shroud wall protruding from said sealing shroud base;

an inner rotor equipped with permanent magnets;

an outer rotor equipped with permanent magnets and arranged in spaced relationship from said inner rotor;

said sealing shroud wall extending between said inner rotor and said outer rotor;

a pump impeller connected with said outer rotor;

a drive motor connected with the inner rotor;

said inner rotor connected with said drive motor being arranged within said sealing shroud;

said outer rotor connected with said pump impeller being arranged externally of said sealing shroud;

at least said sealing shroud wall being formed of electrically non-conductive material;

said sealing shroud is structured such that during operation of said centrifugal pump there are predominantly generated compressive stresses in the sealing shroud wall by the action of the pumped medium;

said sealing shroud further includes a sealing shroud flange; and means for mounting said sealing shroud at said sealing shroud flange at said pump housing such that said sealing shroud is supported in a cantilever fashion and only said sealing shroud flange comes into contact with other parts of the pump.

* * * * *